US006054922A

United States Patent [19]

Smith

[11] Patent Number: 6,054,922

[45] Date of Patent: Apr. 25, 2000

[54] ENHANCED MOVEMENT DETECTION ARRANGEMENT

[75] Inventor: Gordon James Smith, Rochester, Minn.

[73] Assignee: International Business Machines Corporation, Armonk, N.Y.

[21] Appl. No.: 09/229,585

[22] Filed: Jan. 13, 1999

[51] Int. Cl.[7] ..... G08B 13/14

[52] U.S. Cl. ..... 340/568.1; 340/571; 340/686.1; 340/689

[58] Field of Search ..... 340/568.1, 571, 340/686.1, 689, 690, 691.1, 692, 691.7, 693.5, 693.12

[56] References Cited

U.S. PATENT DOCUMENTS

| | | | |
|---|---|---|---|
| 4,540,269 | 9/1985 | Nishiyama | 340/686.1 |
| 4,847,597 | 7/1989 | Dobosi et al. | 340/571 |
| 4,985,695 | 1/1991 | Wilkinson et al. | 340/571 |
| 5,574,786 | 11/1996 | Dayan et al. . | |
| 5,578,991 | 11/1996 | Scholder . | |
| 5,730,009 | 3/1998 | Westfield | 340/571 |
| 5,754,108 | 5/1998 | Ungarsohn | 340/571 |
| 5,760,690 | 6/1998 | French . | |

*Primary Examiner*—Nina Tong

*Attorney, Agent, or Firm*—Robert H. Berdo

[57] ABSTRACT

An anti-theft arrangement includes a sensor (10) that has a conductive seat (22) connected to a first electrical contact (32). The seat (22) has an opening (34) therethrough. The sensor (10) further has a deflectable, conductive cantilever spring (20) connected to a second electrical contact (36). A conductive plate (26) is disposed between the spring (20) and the seat (22). The conductive plate (26) is in constant electrical communication with the spring (20) and is urged in a direction toward the seat (22) by the spring (20). The plate (26) is movable from a switch-off position in which the seat (22) is spaced away from the plate (26), to a switch-on position in which the plate (26) electrically communicates the spring (20) with the seat (22). The sensor (10) further includes an insulating foot (24) fastened to a lower surface of the plate (26), and which has a frusto-conical base (44) locatable directly on a surface of a support member (14). The base (44) tapers away from the surface of the support member (14), and includes a base edge that forms essentially a step-free transition with the surface, so as to prevent the sliding of an object beneath the insulating foot (24). Any sliding movement causes the insulating foot (24) and the plate (26) to tilt, thereby moving the plate (26) from the switch-off position to the switch-on position. Further, lifting of the sensor (10) away from the surface of the support member (14) allows the spring (20) to urge the plate (26) from the switch-off position and into the switch-on position.

36 Claims, 7 Drawing Sheets

ENHANCED MOVEMENT DETECTION ARRANGEMENT

BACKGROUND OF THE INVENTION

1. Field of the Invention

The present invention relates to an enhanced movement detection arrangement, and in particular, to a security arrangement that detects unauthorized movement of an electronic device, such as a computer.

2. Background Information

Computers, in general, have in recent years increased in power and decreased in size. For example, computers have now reached a size where the functionality of a full-size computer system can now be performed by so-called laptop or notebook computers, which are typically small, light weight systems. Moreover, portable electronic organizers, known as personal digital assistants (also known as PDAs), are becoming increasingly popular. Personal digital assistants typically have both a size and weight that are even less than that of even the smallest laptop or notebook computers. For example, a typical personal digital assistant may have a height of only about 4.5 inches, and a weight of only about 6 ounces, so that it may be easily carried in a pocket or purse of a user.

A driving force in the configuration of laptop computers, notebook computers, and personal digital assistants (hereinafter, also portable and/or personal computer), is to make them even smaller and lighter, and thus easier to transport. As laptops and notebook computers, and personal digital assistants, become smaller and lighter, they are also made easier to conceal. The fact that these devices are easy to transport and conceal has led to an increase in the amount of theft of such systems.

Laptop and notebook computers, and personal digital assistants, are generally stolen by people who may see one lying unattended, and who simply pick up the computer and place it in a briefcase, for example. Alternatively, the device may be stolen with no effort being taken to conceal the theft. As a result, both display models, (e.g., those devices placed on display in stores), and personally-owned computers, are being stolen at an alarming rate.

To help prevent the theft of such systems, various security systems have been proposed. For example, it is known to anchor the portable computer to a desk or table. Although this may provide an adequate anti-theft deterrent, the anchors used tend to be unsightly and cumbersome. Moreover, the anchors are typically not fully portable, which may prevent the portable computer from being secured outside of the normal work environment.

It is also known to employ sensors that detect motion, and which may be integrated into the micro-processor of the portable computer. For example, mercury switches have been used which detect a tilting of the portable computer. If the portable computer is tilted by unauthorized movement, an alarm, for example, can be activated. However, the mercury within a mercury switch is highly toxic. As such, the use of such switches raises environmental and safety concerns which must be addressed by a manufacturer. Thus, there is a need for a sensor that does not require mercury for its activation.

Moreover, such switches will only work properly if the switch is in a horizontal position. Thus, the use of a mercury switch will prevent the portable computer from being used on an inclined surface, or at an angle to the horizontal. This is disadvantageous, since laptop computers, as the name implies, may be operated while on the lap of a user. Unless the lap of the user maintains the computer in a horizontal position, a false alarm may result. Therefore, there is a need for a sensor that will allow the computer to be operated beyond a horizontal position.

Further, a mercury switch can be defeated in a relatively easy manner by keeping the portable computer in its horizontal position during its theft. As long as the portable computer is kept horizontal, the mercury switch will not be activated, and an alarm will not sound.

It is also know to provide sensors that detect movement in a vertical direction. For example, a typical sensor may have a switch body, and a vertically-displaceable plunger disposed within the switch body. A spring may be provided to urge the plunger in a downward direction. The sensor is typically disposed on a base of a computer, so that an outwardly-disposed end of the plunger is contactable with a surface of a table, for example. As long as the computer remains on the table, the plunger is retracted and maintained in a predetermined location, and the sensor remains inactivated. However, if the computer is lifted off the table, the spring urges the plunger downward, thus allowing the sensor to assume an activated state.

Typically, the end of the plunger is configured to have a convex (rounded) surface, so as to simulate a foot of the computer. However, this configuration allows the sensor to be defeated merely by sliding a relatively rigid article, such as a piece of cardboard, under the end of the plunger. Thereafter, both the rigid article and the computer can be lifted off the supporting surface (such as the table) without activating the associated alarm system. Alternatively, the computer can be simply slid to the edge of the table, to allow the plunger to be grasped and held in its retracted state. Thus, there is a need for a sensor that is difficult to defeat, and that will detect both sliding and lifting motion of the portable computer.

As noted above, the known sensors may be integrated into, for example, electrically coupled with, the micro-processor of the portable computer. Thus, a keypad of the computer can be used to enter a code, for example, to activate and/or deactivate the sensor. If the correct code is entered, then the sensor may be moved without initiating an alarm condition.

Further, it is also known to utilize the micro-processor to render data stored in a portable computer useless, by erasing the data contained therein and/or by rendering the portable computer inoperable, depending on whether the sensor has been activated or not. However, this arrangement is only intended to prevent the unauthorized use of the system, rather than preventing the theft of the system. As will be appreciated, the knowledge that a stolen portable computer can not be used by the thief, will provide little relief to the authorized user or owner of the portable computer.

SUMMARY OF THE INVENTION

It is, therefore, a principle object of this invention to provide an enhanced movement detection arrangement.

It is another object of the invention to provide an enhanced movement detection arrangement that solves the above mentioned problems.

These and other objects of the present invention are accomplished by the enhanced movement detection arrangement disclosed herein.

According to one aspect of the invention, the sensor consists of a housing, a conductive spring, a conductive seat, a rubber foot, and a conductive orbit flange (i.e., a plate). Each of these components interact with each other to form a sensor that is inexpensive to make, easy to assembly, and difficult to defeat.

Preferably, the conductive components are formed from a conductive plastic, for example, a carbon-filled polycarbonate. Conductive plastic is preferred over other conductive materials, due to its low cost, light weight, and ability to resist corrosion.

Preferably, the seat is engaged with the housing to form a recess in which other components of the sensor are disposed. This configuration will advantageously protect the components within the recess from environmental concerns, such as dust and water.

Preferably, the plate is positioned over an opening in the seat, and between the seat and the spring. Further, preferably the plate has a dimple formed in its upper surface. The dimple is preferably located at a center of the upper surface of the plate, and receives an end of the spring. This configuration advantageously ensures that the plate is properly positioned relative to the spring and the opening in the seat.

According to a further aspect of the invention, the rubber foot is physically and directly attached to the lower surface of the plate. Moreover, the rubber foot includes a trunk portion with a diameter smaller than the opening in the seat and projecting through the opening with a clearance. This will advantageously allow the trunk portion to move freely in both a vertical and horizontal direction, and will allow the trunk to tilt within the opening.

Further, the rubber foot preferably has a frustum base attached to a bottom end of the trunk portion in axial alignment therewith. When the rubber foot is placed on the surface of a support member, such as a table top, the side of the frustum base will extend at an acute angle (i.e., taper away) relative to the surface of the support member. Further, the edge of the base will form essentially a step-free transition with the surface of the support member.

Since the frustum base of the rubber foot forms an acute angle with the surface, any attempt to slide an object beneath the sensor will likely fail. That is, rather than sliding beneath the sensor, the object will slide up the sloping side of the rubber foot. Thus, the present invention advantageously prevents a flat object from being slid therebeneath in an attempt to defeat the sensor.

The rubber foot is preferably formed from an elastomeric alloy. Such a material is relatively non-conductive, for example, with a volume resistivity greater than $10^{10}$ ohm-cm. Thus, the rubber foot will not be electrically coupled with the plate, or the other conductive elements of the sensor.

Further, the rubber foot preferably has a relatively high coefficient of friction. Thus, the rubber foot will tend to grip the surface on which it is disposed.

Additionally, the rubber foot preferably has a low stiffness (i.e., is relatively soft). This will allow the rubber foot to closely conform to the surface upon which it is resting.

Since the rubber foot has a relatively high coefficient of friction, and is relatively soft, if an attempt is made to slide the sensor along the surface upon which it is disposed, the rubber foot will grip the surface, causing the rubber foot to rotate (i.e., tilt) using the point of engagement between the rubber foot and the surface as a pivot point. Due to the clearance between the trunk portion of the rubber foot and the opening in the seat, and due to the relatively long moment arm formed between the surface and the plate, this rotational movement will cause the plate to tilt sufficiently to engage with the seat, thus placing the sensor in a switch-on position. Therefore, the present invention advantageously detects any unauthorized sliding so that the associated security system can be activated.

DETAILED DESCRIPTION OF THE PREFERRED EMBODIMENTS

The invention will now be described in more detail by way of example with reference to the embodiments shown in the accompanying figures. It should be kept in mind that the following described embodiments are only presented by way of example and should not be construed as limiting the inventive concept to any particular physical configuration.

Further, in the application, the terms "upper","lower", "front", "back", "over", "under", "horizontal", vertical", and similar such terms are not to be construed as limiting the invention to a particular orientation. Instead, these terms are used only on a relative basis.

Figure 1:
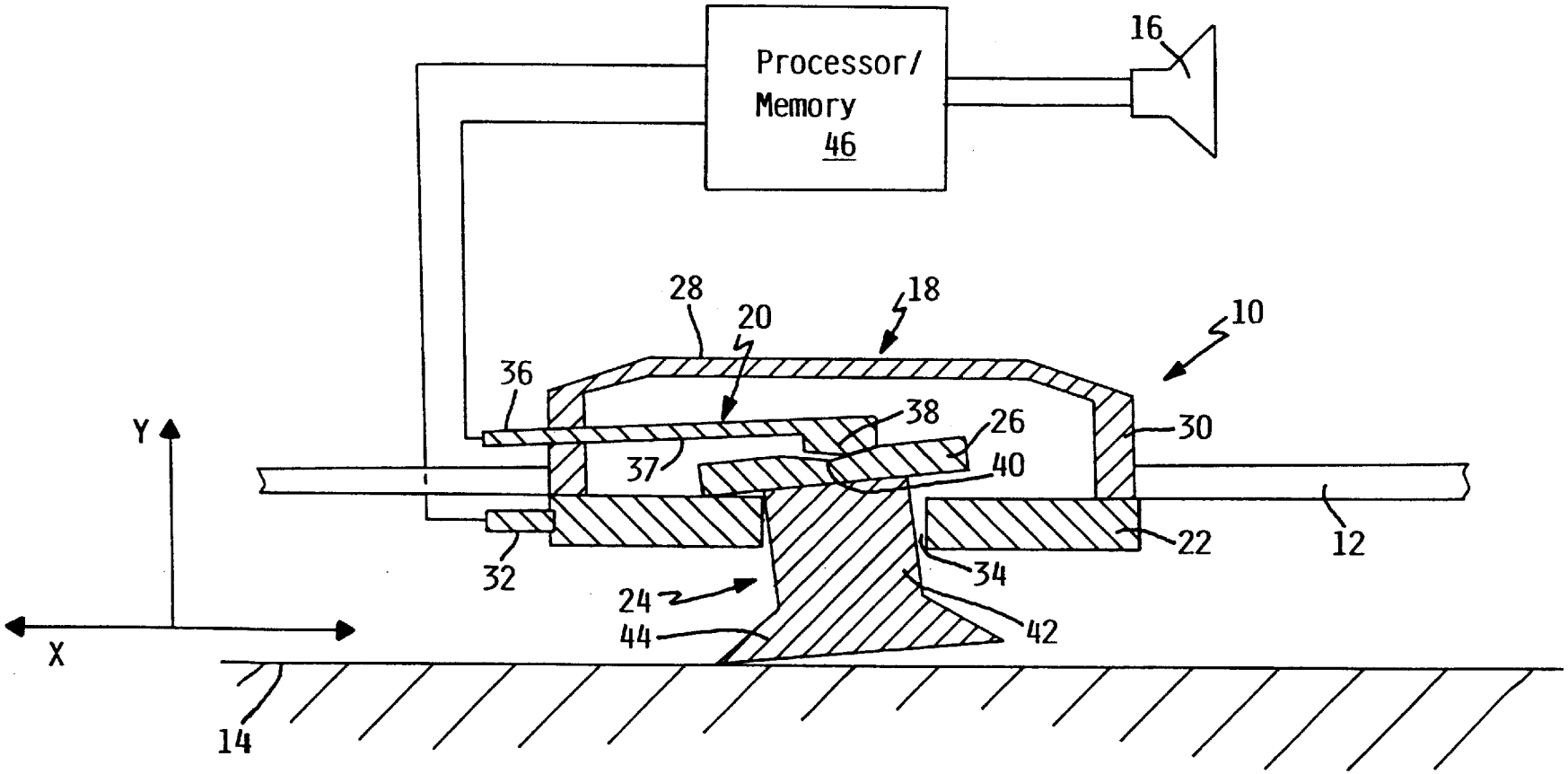
FIG. 1 is a sectional, elevational view of an exemplary embodiment of the present invention, in a switch-on position due to sliding.
Figure 2:
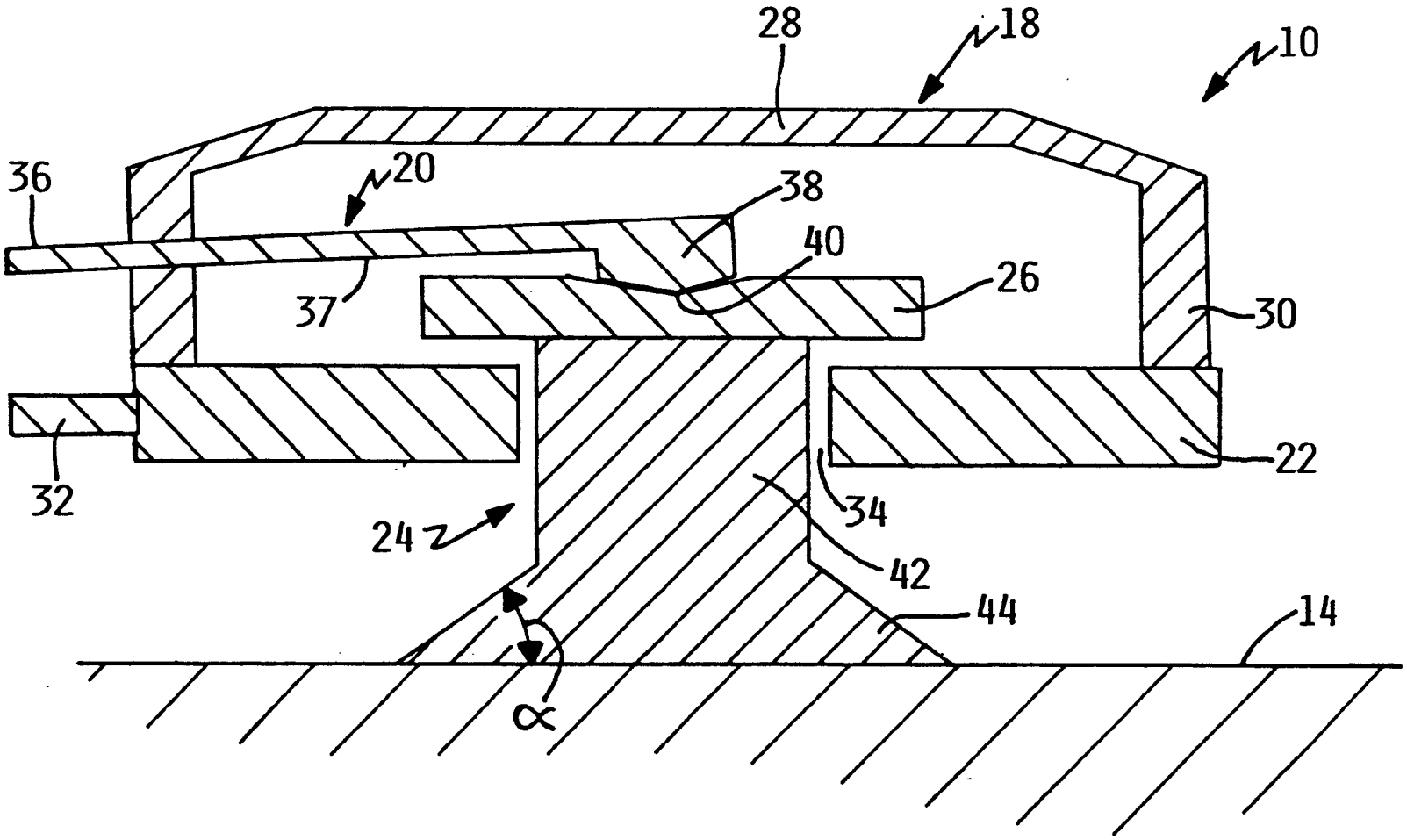
FIG. 2 is a sectional view of the sensor shown in FIG. 1, in a switch-off position.
Figure 3:
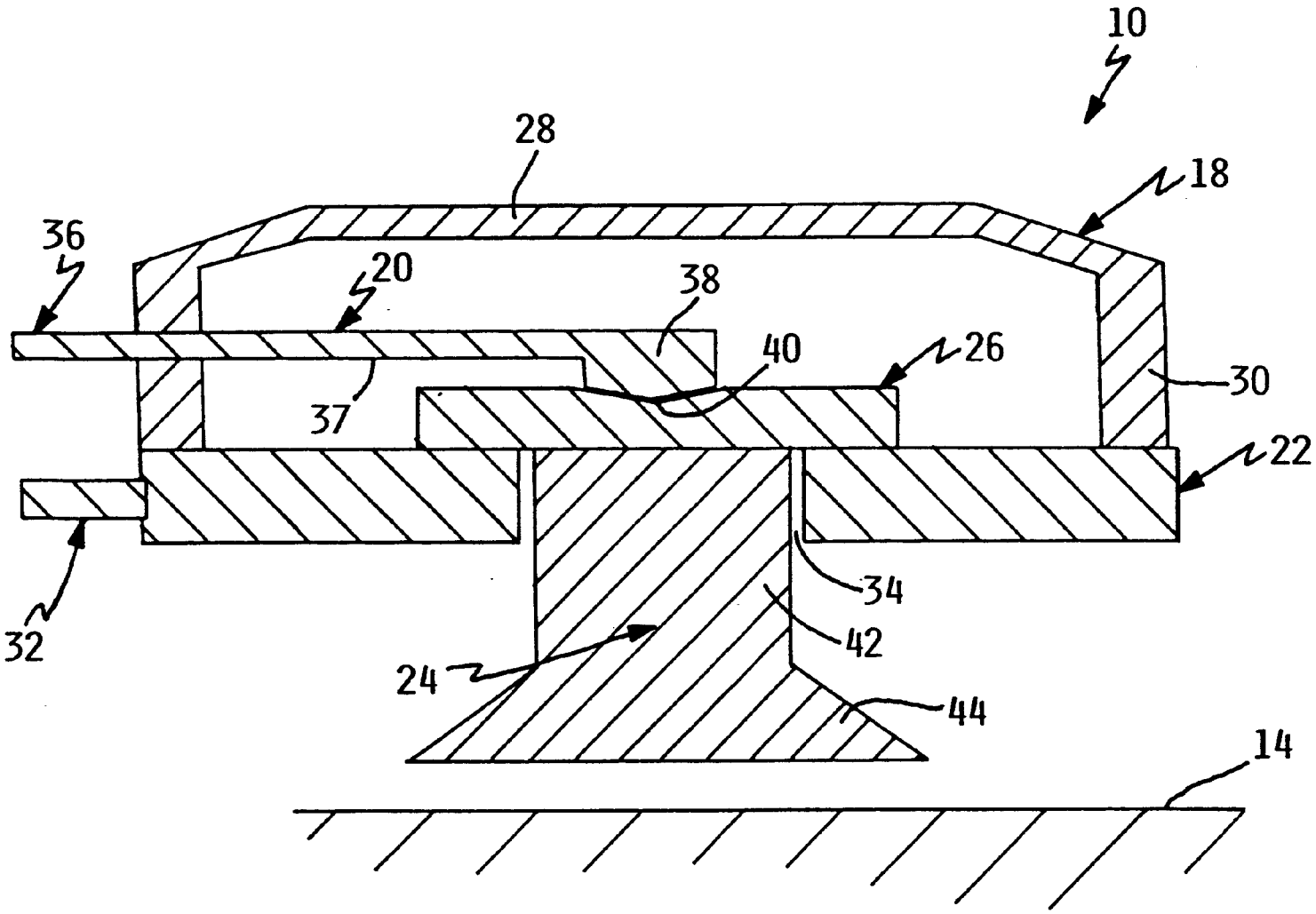
FIG. 3 is a sectional view of the sensor shown in FIG. 1, in a switch-on position due to lifting.

Referring to FIGS. 1 through 3, an exemplary embodiment of a sensor 10 according to the present invention is shown. The sensor 10 is typically connected to a base 12 of a housing of a portable, personal computer, such as a laptop computer, a notebook computer, or a personal digital assistant, for example, to detect movement of the portable computer in both the x-and y-directions. However, the sensor 10 according to the present application may also be used to detect movement of other computer systems which are not readily portable, such as desktop computers, for example. Moreover, the sensor 10 according to the present application may also be used to detect movement of any device that may be subjected to possible theft, for example television sets, stereo equipment, etc. Further, instead of being connected to a base, the sensor may be attached to any appropriate surface of the protected device.

Preferably, since the sensor 10 is attached to the base 12 of the portable computer, for example, when the portable computer is placed on a surface 14, such as a table top, the weight of the portable computer will cause the sensor 10 to be in "switch-off" (i.e., inactivated) position, as shown in FIG. 2. Sliding or lifting of the portable computer will cause the sensor 10 to move to a "switch-on" (i.e., actuated) position, as respectively shown in FIGS. 1 and 3, thus allowing an input/output device, such as alarm 16 to be activated, for example.

As shown in FIG. 1, the sensor 10 in the exemplary embodiment includes a housing 18, a spring 20, a conductive seat 22, a foot 24, and an orbit flange 26 (i.e., a plate). Each of these components and their interrelationship with each other will be described more fully in the paragraphs that follow. Moreover, in this exemplary embodiment, the sensor 10 includes five primary components. Although the present invention is not to be limited to these five components, and may in fact have more or less than these five components, the use of these five components will result in a sensor 10 that is inexpensive to make, easy to assembly, and difficult to defeat.

Preferably, the housing 18 is formed from a relatively non-conductive material, for example, acetal polymer which has a volume resistivity greater than $10^{10}$ ohm-cm. The housing 18 is shown as having a circular shape as viewed from above (see FIG. 4, for example), but other shapes are also possible within the spirit and scope of the present invention. Moreover, in the exemplary embodiment, the housing 18 has a diameter between about 1 cm. and about 2 cm., although other sizes are also contemplated.

The housing 18 includes a relatively flat top portion 28, and a flange 30 that extends around the outer periphery of the top portion 28. As shown, the top portion 28 and the flange 30 form essentially an inverted cup-shape, and define a recess in which other components of the sensor 10 can be disposed, as will be subsequently described. Alternatively, the housing 18 can have a more rounded configuration, so that the transition between the flange 30 and the top portion 28 is seamless. Other configurations of the housing 18 are also possible within the scope of the invention. However, regardless of the configuration, it is preferred that the housing 18 form the desired recess.

Preferably, the conductive seat 22 is fastened, for example using an adhesive, to a free edge of the flange 30 of the housing 18, so as to essentially close off the recess. The conductive seat 22 is preferably a conductive plastic, for example, a carbon-filled polycarbonate, having a volume resistivity between about 1 ohm-cm. and about 1000 ohm-cm. Conductive plastic is preferred to other conductive materials, due to its low cost, light weight, and ability to resist corrosion.

As shown, the seat 22 is electrically coupled to a first electrical contact 32, so as to be in communication with appropriate alarm circuitry. Since such circuitry is well known and capable of development by one of ordinary skill in the art, no further description of this feature is provided.

Figure 4:
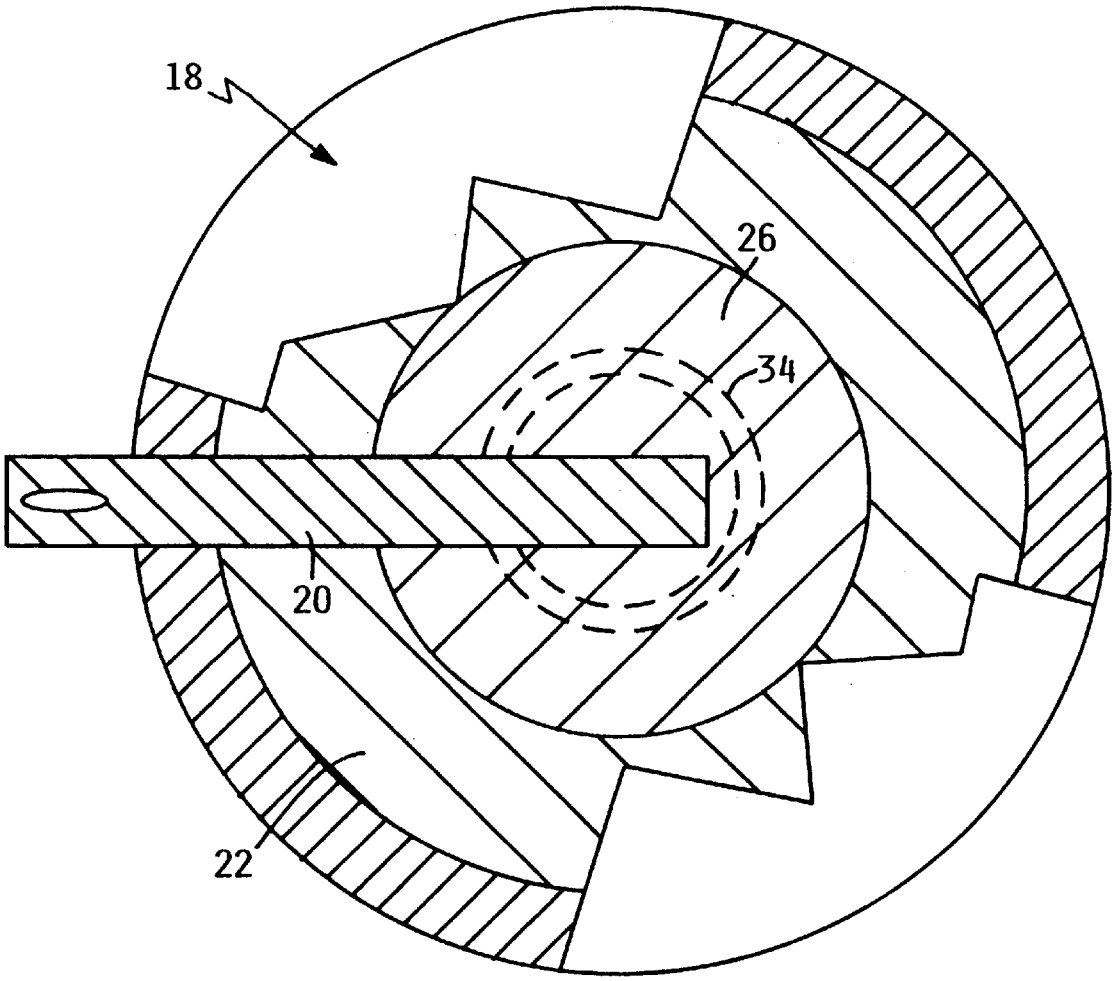
FIG. 4 is a top plan partially cut-away view of the sensor shown in FIG. 1.

As best shown in FIG. 4, the seat 22 is essentially flat, and has an outer peripheral profile of a circle, for example, similar to the outer peripheral shape of the housing 18. However, it is not imperative that the seat 22 be flat, have the same shape as the housing 18, or be a circular shape. However, it is preferred that the seat 22 engage with the entire free edge of the housing flange 30. This will advantageously allow the components within the recess to be protected from environmental concerns, such as dust and water.

Further, and referring back to FIGS. 1–3, the seat 22 has an opening 34 disposed essentially in a center thereof, which allows the foot 24 to extend through the seat 22 and into the recess, as will be more fully described in the paragraphs that follow.

In this exemplary embodiment, the spring 20 is preferably a cantilever-type spring, although other types of springs can be used without departing from the scope of the invention. Further, the spring 20 is formed from a conductive material, such as a conductive plastic. For example, the conductive plastic can be, for example, a carbon-filled polycarbonate, having a volume resistivity between about 1 ohm-cm. and about 1000 ohm-cm. As shown, the spring 20 is electrically coupled to a second electrical contact 36, so as to be in communication with the appropriate alarm circuitry.

Further, the cantilever spring 20 includes a deflectable arm 37 having a first end that is fixed, for example, within the flange 30 of the housing 18 and to the second electrical contact 36, and a free second end. When the arm 37 of the spring 20 is deflected and flexed, for example, by moving the free second end in a direction away from the seat 22, the arm 37 will exert a spring force that acts in a direction toward the seat 22.

Preferably, the arm 37 is arranged to extend essentially parallel to the seat 22 when in a non-deflected position. Further, the free second end has a projection 38 that extends at an angle to the arm 37, and extends generally in a direction toward the seat 22. Moreover, preferably the arm 37 of the spring 20 has a length that will allow the projection 38 to be positioned over a center of the opening 34 in the seat 22.

The plate 26 is positioned over the opening 34 in the seat 22, and between the seat 22 and the projection 38 of the spring 20. Further, preferably, the plate 26 has a dimple 40 formed in its upper surface. The dimple 40 is preferably located at a center of the upper surface, and receives the projection 38 of the spring 20. Thus, the spring 20 engages with the plate 26 via the dimple 40. This ensures that the plate 26 is properly positioned relative to the spring 20 and the opening 34 in the seat 22.

Moreover, the plate 26 is urged toward the seat 22 using the spring 20. When the plate 26 is held against the seat 22 using the spring 20, the "switch-on" condition results, whereby a signal can be transmitted from, for example, the first electrical contact 32 to the second electrical contact 36, by way of the seat 22, plate 26 and spring 20, each of which are in electrical communication with each other. Thus, the associated alarm 16 can be activated.

In this exemplary embodiment, the plate 26 has a circular shape, as best shown in FIG. 4, and is sized larger than the opening 34 in the seat 22 so as to completely cover the opening 34. However, the plate 26 may have other shapes without departing from the scope of the invention. Further, although the plate 26 is illustrated in the exemplary embodiment as being generally flat, the plate 26 is not limited to this configuration. Instead, as used within this specification, the term "plate" connotes any member having either a flat and/or curved surface, with any type of profile.

The plate 26 is preferably formed from a conductive material, such as a conductive plastic. For example, the conductive plastic can be, for example, a carbon-filled polycarbonate, having a volume resistivity between about 1 ohm-cm. and about 1000 ohm-cm.

As previously mentioned, the foot 24 projects through the opening 34 in the seat 22, as best shown in FIGS. 1–3. Further, the foot 24 is physically and directly attached to the lower surface of the plate 26. For example, the foot 24 may be glued to the plate 26, or attached in a variety of other known manners.

Figure 5:
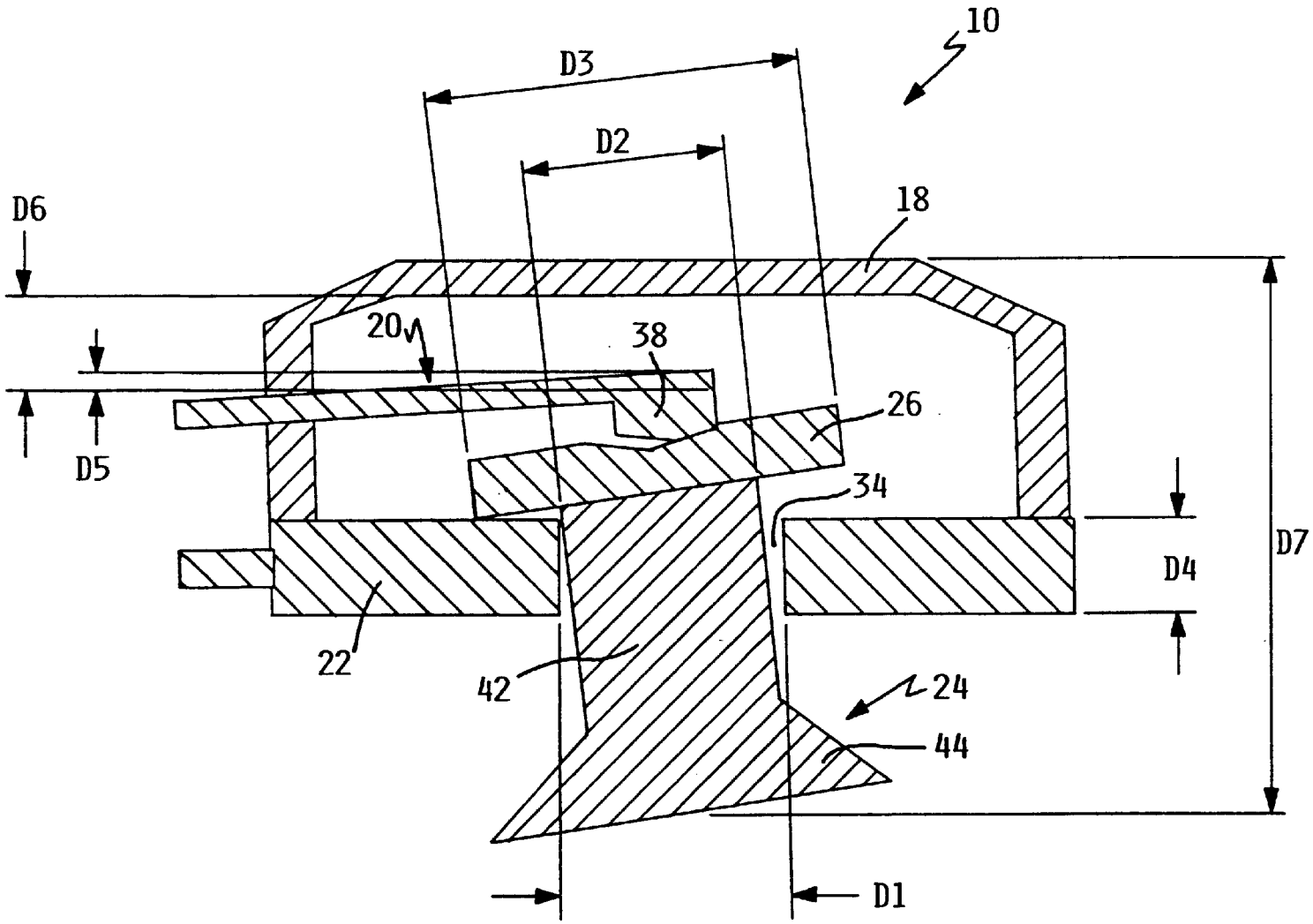
FIG. 5 is an enlarged view of the sensor shown in FIG. 1, depicting various dimensions.

Preferably, and referring also to FIG. 5, the foot 24 includes a trunk portion 42, which preferably has a cylindrical shape, and which projects through the opening 34 in the seat 22 for attachment to the plate 26, as previously described. The trunk portion 42 has a diameter D2 which is less than a diameter D1 of the opening 34, so that the trunk portion 42 passes through the opening 34 in the seat 22 with a clearance. This will allow the trunk portion 42 to move freely in both a vertical direction (i.e., the y-direction, along the axis of the opening 34), and a horizontal direction (i.e., the x-direction).

Moreover, the clearance is preferably selected to allow the trunk to tilt within the opening 34. For example, the minimum preferred clearance (C), which is the diameter (D1) of the opening 34 in the seat 22 minus the diameter (D2) of the trunk portion 42 divided by two (i.e., C=(D1−D2)/2)), can be determined using the following formul:

$$C>2*D4*D5/(D3-D2) \text{ for } D5<D6,$$

where

D1=the diameter of the opening 34 in the seat 22;

D2=the diameter of the trunk portion 42 of the foot 24;

D3=the diameter of the plate 26;

D4=the thickness of the seat 22;

D5=a preferred possible amount of deflection of the spring 20 as measured at the projection 38 (i.e., the distance the end of the spring moves from a non-deflected position to a deflected position during normal use); and D6=the maximum possible amount of deflection of the spring 20 as measured at the projection 38 (i.e., the maximum distance the end of the spring could move before hitting housing 18).

Further, and referring also to FIG. 2, the foot 24 preferably has a frustum (frusto-conic al) base 44 (i.e., a truncated cone-shaped base) attached to a bottom end of the trunk portion 42 in axial alignment therewith. When the foot 24 is placed on the surface 14 of the support member, such as a table top, the side of the frustum base 44 will rise at an acute angle α (i.e., taper away) from the planar surface 14. Further, the edge of the base 44 will for m essentially a step-free (i.e., smooth) transition with the surface 14 of the support member. This configuration advantageously will prevent the sliding of an object beneath the foot 24.

In this exemplary embodiment, the entire foot 24 is formed from a rubber material, such as an elastomeric alloy. Such a material is relatively non-conductive, for example, with a volume resistivity greater than $10^{10}$ ohm-cm. Alternatively, only the base 44 may be formed of the rubber material, with the trunk portion 42 being formed of any other non-conductive material. For example, the trunk portion 42 can be made of the same material as housing 18. Thus, the foot 24 will not be electrically coupled with the plate 26, or the other conductive elements of the sensor 10.

Further, preferably at least the base 44 of the foot 24 has a relatively high coefficient of friction, for example, greater than 0.1. Thus, the foot 24 will tend to grip the surface 14 on which it is disposed.

Additionally, preferably at least the base 44 of the foot 24 has a low stiffness (i.e., is relatively soft). For example, the base 44 may have a Shore A Durometer rating between about 10 and about 65, and is preferably between about 50 and about 55. This will allow the base 44 to closely conform to the surface 14 upon which it is resting.

As previous mentioned, the sensor 10 is preferably attached to the base 12 of a portable computer, for example, so that the sensor 10 serves as a foot of the portable computer. For example, and as shown in FIG. 1, the base 12 could be provided with an opening sized to allow the housing 18 to be received therein. Alternatively, the sensor 10 can be disposed within the portable computer, and attached to an inner surface of the base 12 of the portable computer by adhering the seat 22 of the sensor 10 to the base 12. The base 12 could then be provided with an opening that allows the foot 24 to project therethrough. Further alternative arrangements and configurations for fastening the sensor 10 to a portable computer are also within the scope of the present invention.

As best shown in FIG. 2, when a portable computer utilizing the sensor 10 according to the present invention is placed on the surface 14, for example, on a table, the weight of the portable computer will cause the foot 24 to push the plate 26 up and away from the seat 22, thus breaking the connection between the first electrical contact 32 and the second electrical contact 36. The upward movement of the plate 26 will cause the spring 20 to deflect, until the spring 20 reaches a desired deflection point. For example, the spring 20 can be allowed to deflect until it abuts against the inside of the housing 18. Alternative configurations for limiting the deflection of the spring 20 may also be realized without departing from the scope of the invention. However, as will be appreciated, since the spring 20 is deflected, the spring 20 will now be exerting a spring force against the plate 26. Moreover, while in this position, the sensor 10 will be in a switch-off position, and no alarms or other security devices will be activated.

However, once the personal computer is lifted, as shown in FIG. 3, the spring force will urge the plate 26 against the seat 22, thus placing the sensor 10 in a switch-on position. This switch-on position can be detected, for example, by using appropriate circuitry that is coupled in any known manner to a micro-processor/memory 46 (see FIG. 1), for example, of the personal computer. If the personal computer is lifted before an appropriate password, for example, is entered, the micro-processor/memory 46 initiates security measures. For example, alarm 16 or lights (not shown) can be activated.

Moreover, and as best shown in FIG. 1, since the foot 24 has a relatively high coefficient of friction, and is relatively soft, if the portable computer is slid along the surface 14 upon which it is disposed, the foot 24 will grip the surface 14, causing the foot 24 to rotate (i.e., tilt) using the point of engagement between the foot 24 and the surface 14 as a pivot point. Due to the clearance between the trunk portion 42 of the foot 24 and the opening 34 in the seat 22, and due to the relatively long moment arm between the surface 14 and the plate 26, this rotational movement will cause the plate 26 to tilt sufficiently to engage with the seat 22, thus placing the sensor 10 in a switch-on position. Therefore, unlike prior art alarm switches that utilize vertically-displaceable plungers, which can be defeated simply by sliding the personal computer to an edge of the desktop to allow the plunger to be gripped and held in its retracted state, the present invention advantageously detects any unauthorized sliding so that the associated security system is activated.

Further, since the frustum base 44 of the foot 24 forms an acute angle α with the surface 14, any attempt to slide an object, such as a rigid piece of cardboard, beneath the sensor 10 will likely fail. That is, rather than sliding beneath the sensor 10, the object will slide up the sloping side of the base 44. Thus, unlike prior art alarm switches that utilize vertically-displaceable plungers, which can be defeated simply by sliding a flat rigid object beneath the switch to retain the switch in a retracted state so that both the rigid object and the computer can be lifted off the supporting surface 14 without activating the associated alarm system, the present invention advantageously prevents such a flat object from being slid therebeneath.

Referring back to FIG. 5, preferred relative dimensions and values for an exemplary embodiment of the present invention are as follows:

D1=0.35 cm. (diameter of the opening 34 in the seat 22);

D2=0.17 cm. (diameter of the trunk portion 42 of the foot 24);

D3=0.65 cm. (diameter of the plate 26);

D4 =0.20 cm. (thickness of the seat 22);

D5 =0. 10 cm. (preferred possible amount of deflection of the spring 20 as measured at the projection 38);

D6=0.25 cm. (maximum possible amount of deflection of the spring 20 as measured at the projection 38); and D7=1.5 cm. (full height of the sensor 10).

Of course, the sensor 10 according to the present invention is not limited to these particular dimensions. Instead, the sensor 10 can be much larger, or smaller, without departing from the spirit of the invention. Moreover, the relativeness of the dimensions can likewise be changed without departing from the spirit of the invention.

Figure 6:
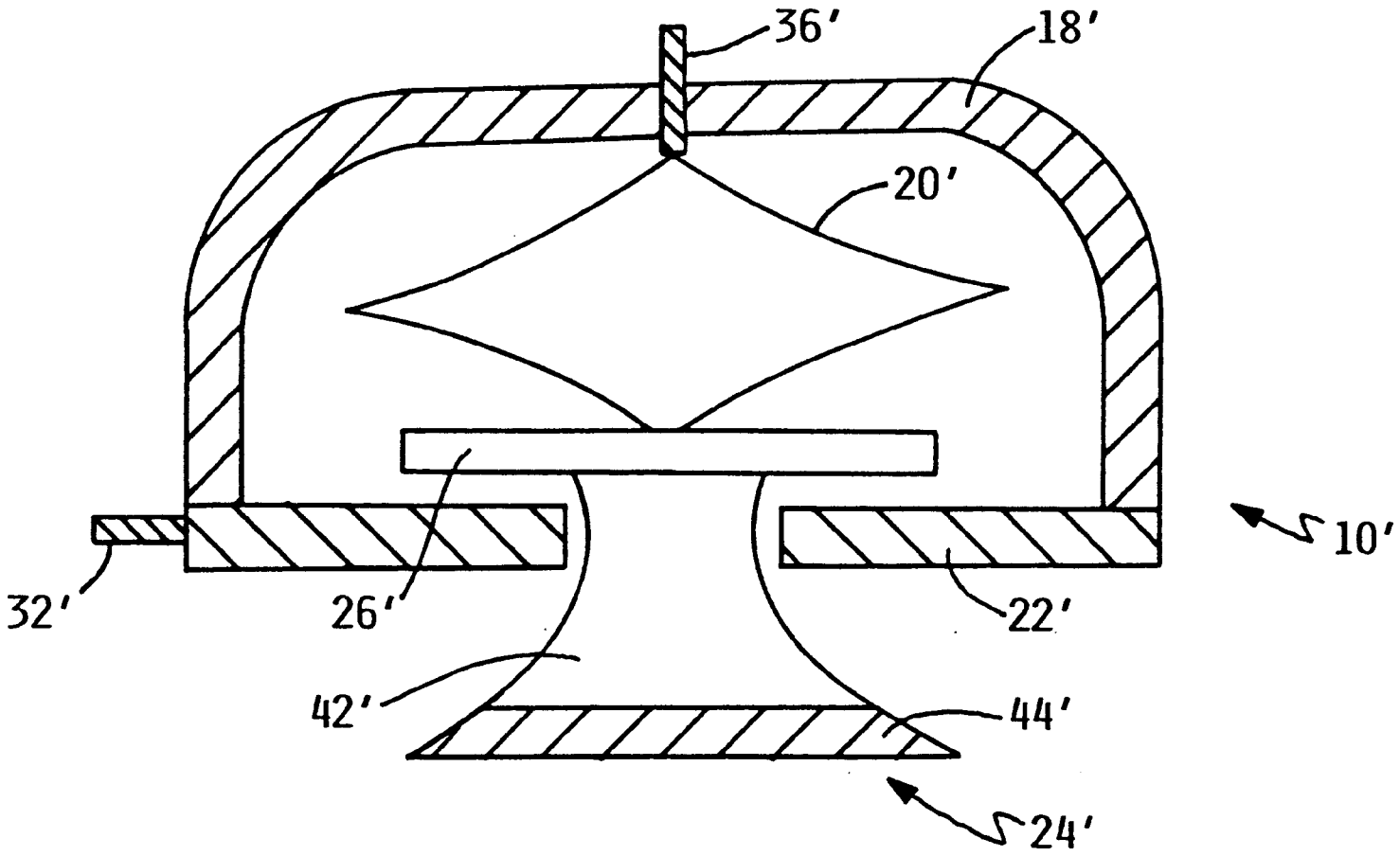
FIG. 6 is an alternative exemplary embodiment of the present invention.
Figure 7:
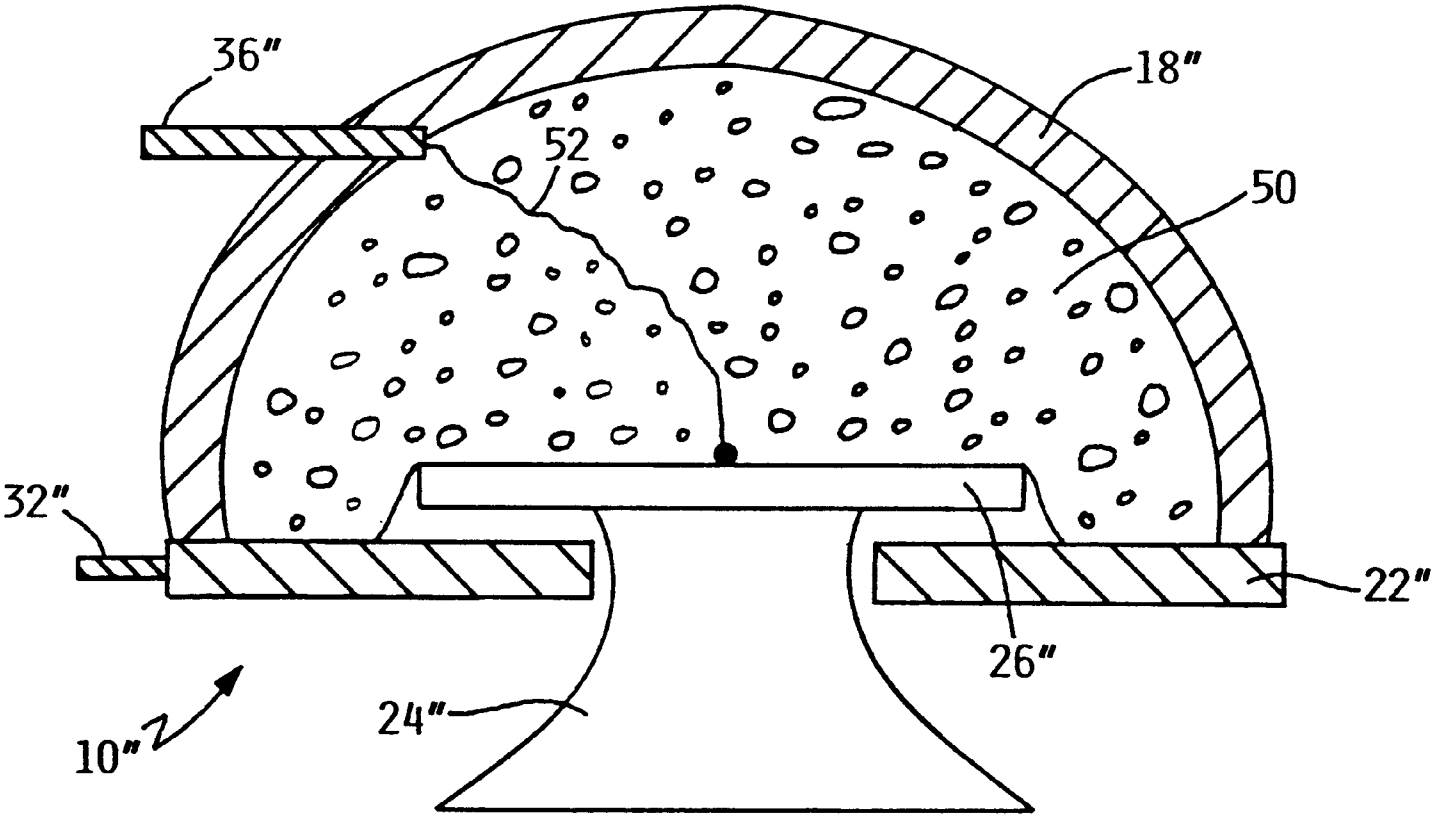
FIG. 7 is a further alternative exemplary embodiment of the present invention.

Referring briefly to FIGS. 6 and 7, two alternative exemplary embodiments of the present invention are shown. In FIG. 6, the sensor 10' is similar in structure and function to the sensor 10 of the previously-described embodiment, except that instead of a cantilever spring 20, a leaf spring 20' is provided. Leaf spring 20' is in axial alignment with the plate 26', second electrical contact 36', and foot 24'. In order to maintain the plate 26' in a centered position, instead of forming a dimple in the plate 26' as in the previous embodiment, the end of leaf spring 20' may be permanently affixed to the plate 26'. For example, the leaf spring 20' may be glued to the plate 26'.

Further, in this exemplary embodiment, the base 44' of the foot 24' is formed from a rubber material, whereas the trunk portion 42' is formed of the same material as the housing 18'. Of course, the foot 24' may be formed entirely of the rubber material, as previously described in connection with the first exemplary embodiment. Moreover, and as in the previously described embodiment, the housing 18' is connected to conductive seat 22', which is in turn connected to the first electrical contact 32'.

In the alternative exemplary embodiment shown in FIG. 7, the sensor 10" is not provided with a spring. Instead, the space within the housing 18" is filled with a non-conductive foam material 50. For example, the foam material 50 may be a foam rubber having a relatively low stiffness, for example, a Shore A Durometer rating less than 10. The foam material 50 is used to urge the plate 26" into a switch-on position, in a manner similar to the springs 20 and 20' of the previous embodiments. Further, the foam material 50 preferably extends around the plate 26" and in contact with the seat 22" so as to maintain the plate 26" in a centered position.

A conductive wire 52 is provided which extends from the plate 26", through the foam material 50, and to the second electrical contact 36" in order to electrically couple the plate 26" to the second electrical contact.

As in the previously described embodiments, the housing 18" is connected to conductive seat 22", which is in turn connected to the first electrical contact 32". Further, the foot 24" is connected to the plate 26" as in the previous embodiments.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. A sensor for detecting movement, comprising:

a first conductive member connectable to a first electrical contact;

a second conductive member spaced away from said first conductive member and being connectable to a second electrical contact;

a third conductive member that is in constant electrical communication with said first conductive member, and is movable from a switch-off position in which said third conductive member is spaced away from said second conductive member, to a switch-on position in which said third conductive member electrically communicates said first conductive member with said second conductive member; and an insulating member attached to said third conductive member, and being contactable with a surface of a support member, said insulating member causing said third conductive member to move from the switch-off position to the switch-on position if an attempt is made to slide the sensor along the surface of the support member.

2. The sensor defined in claim 1, wherein said first conductive member comprises a spring having a first end fixable to the first electrical contact, and a second end in contact with said third conductive member; wherein said second conductive member comprises a seat having an opening formed therein, said opening being disposed in general alignment with the second end of said spring; wherein said third conductive member comprises a plate disposed over the opening in said seat, and under the second end of said spring; and wherein said insulating member extends through the opening in said seat and is attached to a lower surface of said plate.

3. The sensor defined in claim 2, further comprising a housing member disposed over and connected to said seat, said housing member and said seat forming a space in which said spring and said plate are disposed.

4. The sensor defined in claim 3, wherein said spring comprises a cantilever spring having the first end fixed to said housing.

5. The sensor defined in claim 2, wherein said insulating member includes a trunk portion that extends through the opening in said seat with a mechanical clearance.

6. The sensor defined in claim 5, wherein the mechanical clearance is defined in accordance with the following formulas:

$$C=(D1-D2)/2; \text{ and}$$

$$C>2*D4*D5/(D3-D2) \text{ for } D5<D6,$$

where

D1=a diameter of the opening in said seat;

D2=a diameter of the trunk portion of said insulating member;

D3=a diameter of said plate;

D4=a thickness of said seat (i.e., a depth of the opening);

D5=a preferred possible deflection of said spring as measured at the second end; and D6=maximum possible deflection of said spring.

7. The sensor defined in claim 6, wherein the mechanical clearance allows said plate to assume a tilted position relative to said seat, with an edge of said plate in direct contact with said seat, when the sensor is urged in a direction parallel to the surface of the support member.

8. The sensor defined in claim 7, wherein said insulating member is comprised of an elastomeric alloy having a Shore A Durometer rating between about 10 and about 65, and a coefficient of friction greater than 0.1.

9. The sensor defined in claim 8, wherein said elastomeric alloy grips the surface of the support member to prevent sliding of the insulating member when the sensor is urged in the direction parallel to the surface of the support member.

10. The sensor defined in claim 5, wherein said insulating member further includes a frusto-conical base attached to an end of said trunk portion, said base tapering away from the surface of the support member and having a base edge that forms essentially a step-free transition with the surface of the support member, so as to prevent the sliding of an object beneath said insulating member.

11. The sensor defined in claim 2, wherein said plate has a dimple formed in an upper surface thereof, and wherein said spring has a projection located on the second end, said projection being received within said dimple to maintain said plate in a desired lateral position relative to said seat.

12. The sensor defined in claim 2, wherein said plate, said spring and said seat are each comprised of a conductive plastic.

13. The sensor defined in claim 2, wherein said spring exerts a force against said plate and urges said plate from the switch-off position and into the switch-on position when said insulating member is separated from the surface of the support member.

14. A sensor for detecting movement, comprising:

a first conductive member connectable to a first electrical contact;

a second conductive member spaced away from said first conductive member and being connectable to a second electrical contact;

a third conductive member that is in constant electrical communication with said first conductive member, and is movable from a switch-off position in which said third conductive member is spaced away from said second conductive member, to a switch-on position in which said third conductive member electrically communicates said first conductive member with said second conductive member; and an insulating member having one end attached to said third conductive member, and another end contactable with a surface of a support member, whereby movement of the sensor relative to the surface of the support member causes said insulating member to change in position so that said third conductive member is moved from the switch-off position to the switch-on position, said insulating member having a frusto-conical base that tapers away from the surface of the support member and which includes a base edge that forms essentially a step-free transition with the surface of the support member, so as to prevent the sliding of an object beneath said insulating member.

15. The sensor defined in claim 14, wherein said first conductive member comprises a spring having a first end fixable to the first electrical contact, and a second end in contact with said third conductive member; wherein said second conductive member comprises a seat having an opening formed therein, said opening being disposed in general alignment with the second end of said spring; wherein said third conductive member comprises a plate disposed over the opening in said seat, and under the second end of said spring; and wherein said insulating member extends through the opening in said seat and is attached to a lower surface of said plate.

16. The sensor defined in claim 15, further comprising a housing member disposed over and connected to said seat, said housing member and said seat forming a space in which said spring and said plate are disposed.

17. The sensor defined in claim 16, wherein said spring comprises a cantilever spring having the first end fixed to said housing.

18. The sensor defined in claim 15, wherein said insulating member includes a trunk portion attached to an upper portion of the frusto-conical base and that extends through the opening in said seat with a mechanical clearance.

19. The sensor defined in claim 18, wherein the mechanical clearance is defined in accordance with the following formulas:

$$C=(D1-D2)/2; \text{ and}$$

$$C>2*D4*D5/(D3-D2) \text{ for } D5<D6,$$

where

D1=a diameter of the opening in said seat;

D2=a diameter of the trunk portion of said insulating member;

D3=a diameter of said plate;

D4=a thickness of said seat (i.e., a depth of the opening);

D5=a preferred possible deflection of said spring as measured at the second end; and D6=a maximum possible deflection of said spring.

20. The sensor defined in claim 19, wherein the mechanical clearance allows said plate to assume a tilted position relative to said seat, with an edge of said plate in direct contact with said seat, when the sensor is urged in a direction parallel to the surface of the support member.

21. The sensor defined in claim 20, wherein said insulating member is comprised of an elastomeric alloy having a Shore A Durometer rating of between about 10 and about 65, and a coefficient of friction greater than 0.1.

22. The sensor defined in claim 21, wherein said elastomeric alloy grips the surface of the support member to prevent sliding of the insulating member when the sensor is urged in the direction parallel to the surface of the support member.

23. The sensor defined in claim 15, wherein said plate has a dimple formed in an upper surface thereof, and wherein said spring has a projection located on the second end, said projection being received within said dimple to maintain said plate in a desired lateral position relative to said seat.

24. The sensor defined in claim 15, wherein said plate, said spring and said seat are each comprised of a conductive plastic.

25. The sensor defined in claim 15, wherein said spring exerts a force against said plate and urges said plate from the switch-off position and into the switch-on position when said insulating member is separated from the surface of the support member.

26. A sensor for detecting motion, comprising:

an electric switch that is actuatable to selectively open a circuit and close the circuit; and an insulating member connected to said electric switch, and having a frusto-conical base that is positionable against a supporting surface, said base tapering away from a base edge thereof so as to form essentially a step-free transition with the surface, so as to prevent the sliding of an object beneath said insulating member, said base being comprised of a rubber material, so as to prevent the insulating member from sliding over the supporting surface, and so that said base grips the surface whereby any attempt to slide said insulating member relative to the surface causes the insulating member to actuate said switch.

27. The sensor defined in claim 26, wherein said insulating member includes a trunk portion having one end attached to an upper portion of the frusto-conical base, and a second end that is connected to said electric switch.

28. The sensor defined in claim 26, wherein said base is comprised of an elastomeric alloy.

29. The sensor defined in claim 28, wherein said elastomeric alloy has a Shore A Durometer rating of between about 10 and about 65, and a coefficient of friction greater than 0.1.

30. The sensor defined in claim 26, wherein said electric switch comprises:

a housing;

a seat attached to a base of said housing so that said seat and said housing form a space, said seat having an opening therein; and a plate located within the space; and wherein said insulating member includes a trunk portion extending through the opening in said seat and being connected to said plate, said trunk portion further being connected to said base outside of the space.

31. The sensor defined in claim 30, wherein said electric switch further includes means for urging said plate from an inactivated position in which said plate is spaced away from said seat, to an actuated position in which said plate is in contact with said seat.

32. The sensor defined in claim 31, wherein said means comprises a foam material that essentially fills the space.

33. An anti-theft arrangement, comprising:

a device to be protected from theft, said device having a security arrangement which is responsive to unauthorized movement of said device; and a sensor attached to said device for detecting movement of said device relative to a surface of a support member upon which said device is disposed, comprising:

a housing;

a conductive seat fastened to said housing so that said housing and said seat form a space, said seat being connected to a first electrical contact that is in electrical communication with the security arrangement, said seat having an opening therethrough;

a deflectable, conductive cantilever spring connected to a second electrical contact that is in electrical communication with the security arrangement, and having an arm that is essentially parallel to said conductive seat when said spring is in a non-deflected state, said arm having a first end fixed to said housing, and a free second end disposed within the space and over the opening;

a conductive plate disposed within the space and between said spring and said seat, said plate being positioned over the opening and under the free second end, said conductive plate being in constant electrical communication with said spring and being urged in a direction toward said seat by said spring, said plate being movable from a switch-off position in which said seat is spaced away from said plate, to a switch-on position in which said plate electrically communicates said spring with said seat; and an insulating foot having a trunk portion that passes through the opening in said seat and which has an upper end fastened to a lower surface of said plate, and having a frusto-conical base attached to a lower end of said trunk portion and being locatable directly on the surface of the support member, said base tapering away from the surface of the support member and including a base edge that forms essentially a step-free transition with the surface, so as to prevent the sliding of an object beneath said insulating foot;

whereby any sliding movement of said device relative to the surface of the support member causes said insulating foot and said plate to tilt, thereby moving said plate from the switch-off position to the switch-on position;

whereby lifting said device away from the surface of the support member allows said spring to urge said plate from the switch-off position and into the switch-on position; and whereby when said plate is in a switch-on condition, a signal is transmittable through the first electrical contact and through the second electrical contact, thereby initiating the security arrangement.

34. A personal computer, comprising:

a housing;

a processor disposed within said housing;

memory coupled to said processor and disposed within said housing;

at least one input/output device coupled with said processor; and a sensor attached to said housing, and being for detecting movement, comprising:

a first conductive member connectable to a first electrical contact;

a second conductive member spaced away from said first conductive member and being connectable to a second electrical contact;

a third conductive member that is in constant electrical communication with said first conductive member, and is movable from a switch-off position in which said third conductive member is spaced away from said second conductive member, to a switch-on position in which said third conductive member electrically communicates said first conductive member with said second conductive member; and an insulating member attached to said third conductive member, and being contactable with a surface of a support member, said insulating member causing said third conductive member to move from the switch-off position to the switch-on position if an attempt is made to slide the sensor along the surface of the support member.

35. A personal computer, comprising:

a housing;

a processor disposed within said housing;

memory coupled to said processor and disposed within said housing;

at least one input/output device coupled with said processor; and a sensor attached to said housing, and being for detecting movement, comprising:

a first conductive member connectable to a first electrical contact;

a second conductive member spaced away from said first conductive member and being connectable to a second electrical contact;

a third conductive member that is in constant electrical communication with said first conductive member, and is movable from a switch-off position in which said third conductive member is spaced away from said second conductive member, to a switch-on position in which said third conductive member electrically communicates said first conductive member with said second conductive member; and an insulating member having one end attached to said third conductive member, and another end contactable with a surface of a support member, whereby movement of the sensor relative to the surface of the support member causes said insulating member to change in position so that said third conductive member is moved from the switch-off position to the switch-on position, said insulating member having a frusto-conical base that tapers away from the surface of the support member and which includes a base edge that forms essentially a step-free transition with the surface of the support member, so as to prevent the sliding of an object beneath said insulating member.

36. A personal computer, comprising:

a housing;

a processor disposed within said housing;

memory coupled to said processor and disposed within said housing;

at least one input/output device coupled with said processor; and a sensor attached to said housing, and being for detecting motion, comprising:

an electric switch that is actuatable to selectively open a circuit and close the circuit; and an insulating member connected to said electric switch, and having a frusto-conical base that is positionable against a supporting surface, said base tapering away from a base edge thereof so as to form essentially a step-free transition with the surface, so as to prevent the sliding of an object beneath said insulating member, said base being comprised of a rubber material, so as to prevent the insulating member from sliding over the supporting surface, and so that said base grips the surface whereby any attempt to slide said insulating member relative to the surface causes the insulating member to actuate said switch.

* * * * *